US010577764B1

(12) United States Patent
Barker

(10) Patent No.: US 10,577,764 B1
(45) Date of Patent: Mar. 3, 2020

(54) FOLDABLE OUTDOOR PANEL ASSEMBLY

(71) Applicant: Ricky Claude Barker, Miramar, FL (US)

(72) Inventor: Ricky Claude Barker, Miramar, FL (US)

( * ) Notice: Subject to any disclaimer, the term of this patent is extended or adjusted under 35 U.S.C. 154(b) by 0 days.

(21) Appl. No.: 16/354,790

(22) Filed: Mar. 15, 2019

Related U.S. Application Data

(60) Provisional application No. 62/643,207, filed on Mar. 15, 2018.

(51) Int. Cl.
*E01F 9/627* (2016.01)
*G09F 7/22* (2006.01)

(52) U.S. Cl.
CPC ..... *E01F 9/627* (2016.02); *G09F 7/22* (2013.01)

(58) Field of Classification Search
CPC ..... E01F 9/627; E01F 9/629; G09F 7/22
See application file for complete search history.

(56) References Cited

U.S. PATENT DOCUMENTS 3,250,032 A * 5/1966 Von Gal, Jr. ..... G09F 7/22 40/493
4,575,036 A * 3/1986 Allekotte ..... G09F 7/22 248/130
4,879,965 A * 11/1989 Valley ..... G09F 7/22 116/209
4,912,865 A * 4/1990 Ellsworth ..... G09F 7/22 40/602
5,377,945 A * 1/1995 Steinke ..... E01F 9/627 248/292.11
7,389,603 B1 * 6/2008 Brumfield ..... A45F 3/44 173/91
8,613,412 B1 * 12/2013 Donaldson ..... A45F 3/44 248/156
2008/0067299 A1 * 3/2008 Ebel ..... E01F 9/629 248/145
2008/0131201 A1 * 6/2008 Audet ..... E01F 9/623 404/10
2008/0209784 A1 * 9/2008 Brodie ..... E04H 12/2215 40/607.04
2010/0266337 A1 * 10/2010 Lapointe ..... E01F 9/629 404/11

(Continued)

*Primary Examiner* — Gary C Hoge
(74) *Attorney, Agent, or Firm* — John Rizvi; John Rizvi, P.A.—The Patent Professor

(57) ABSTRACT

A foldable outdoor panel assembly is provided including an outdoor panel and a rotating mount assembly for maintaining the outdoor panel in a desired first orientation. The rotating mount assembly includes a first mount assembly connected to the panel and including a first mount, a first magnet having a first polarity and a second magnet having a second polarity. The rotating mount assembly further includes a second mount assembly having a second mount ratably connected to the first mount and including a third magnet having the first polarity. The second mount is connected to a post or other structure attached to the ground. The position of the first magnet adjacent to the third magnet maintains the panel in the first orientation or in an un-deflected condition while the position of the second magnet adjacent to the third magnet biases the panel from a second orientation or deflected condition back to the first orientation or un-deflected condition.

20 Claims, 10 Drawing Sheets

(56) References Cited

U.S. PATENT DOCUMENTS

| | | | | |
|---|---|---|---|---|
| 2012/0280194 | A1* | 11/2012 | Stanojevic | A47C 1/121<br>256/26 |
| 2013/0298433 | A1* | 11/2013 | Delorenzo | G09F 7/22<br>40/606.15 |
| 2016/0335931 | A1* | 11/2016 | Dalton | G09F 15/0087 |
| 2018/0010308 | A1* | 1/2018 | Mandal | E01F 9/627 |

* cited by examiner

FOLDABLE OUTDOOR PANEL ASSEMBLY

CROSS-REFERENCE TO RELATED APPLICATION

This application claims the benefit of U.S. Provisional Patent Application Ser. No. 62/643,207, filed on Mar. 15, 2018, which is incorporated by reference herein in its entirety.

FIELD OF THE INVENTION

The present invention relates generally to movable or deflectable panel assemblies, and more particularly, to a foldable outdoor panel assembly that is magnetically resettable from a deflected condition to an un-deflected condition.

BACKGROUND OF THE INVENTION

It is important in the use of many panel-type assemblies or displays to maintain the orientation of the panel such that it can be easily observed or used by a member of the public. This is particularly true of panel assemblies which are used and located outdoors. For example, street or other informational signs need to be kept in the proper orientation to be of benefit to the public. Additionally, backing panels of the type used for sports need to be kept in a particular orientation to be useful.

Panels utilized outdoors are subject to various conditions which can deflect them from their useful orientation. By their very nature, panels are subject to winds which impact the panel and can twist, bend, distort or even break a panel off of its supporting structure. Additionally, flying objects can impact the panels and permanently deflect them from their useful orientation. The flying objects can be due to flying debris carried by the wind or thrown or otherwise projected objects which impact the panels.

Some mounting devices have been developed to allow a panel to bend or flex relative to its base during a deflecting event and return to the desired orientation when the deflecting event has diminished or passed. However, these mounting devices typically incorporate some sort of mechanical connection or device that is subject to breakage or failure. Many mounting devices incorporate springs to return the panels to their upright condition. The springs are subject to weakening and even breakage due to multiple repeated flexing as the material they are formed from are subject to stress failure. In the course of a panel's useful life, these mounting devices may be subject to thousands of repeated flexings which stress them to the point of failure.

Accordingly, there is an established need for a durable panel mounting device that solves at least one of the aforementioned problems. For example, there remains a need for a durable panel mounting device which can flex to prevent damage of the panel and return the panel to its useful orientation.

SUMMARY OF THE INVENTION

The present invention is directed to magnetically resettable panel assemblies that are capable of maintaining a panel in a first orientation in the absence of external forces and move the panel from a second orientation deflected by external forces back to the first orientation. The magnetically resettable panel assembly includes an outdoor panel and a rotating mount assembly for maintaining the outdoor panel in a desired first orientation. The rotating mount assembly includes a first mount assembly connected to the panel and including a first mount, a first magnet having a first polarity and a second magnet having a second polarity. The rotating mount assembly further includes a second mount assembly having a second mount ratably connected to the first mount and including a third magnet having the first polarity. The second mount is connected to a post or other structure attached to the ground. The position of the first magnet adjacent to the third magnet maintains the panel in the first orientation or in an un-deflected condition while the position of the second magnet adjacent to the third magnet biases the panel from a second orientation or deflected condition back to the first orientation or un-deflected condition.

In a first implementation of the invention, a resettable panel assembly comprises a panel and a rotating mount assembly attached to the panel. The rotating mount assembly is rotatable between a first condition where the panel is free from external forces and a second condition wherein the panel is deflected by external forces. The rotating mount assembly includes a first mount assembly and a second mount assembly. The first mount assembly comprises a first mount, a first magnet having a first polarity and a second magnet having a second polarity opposite the first polarity. In turn, the second mount assembly comprises a second mount and a first magnet having the second polarity. The rotating mount assembly further includes a pivotable connection rotatably connecting the first mount to the second mount about a pivot axis. The panel is carried by one of the first and second mounts. The panel is magnetically biased to the first condition when the first magnet of the first mount assembly is adjacent to the first magnet of the second mount assembly, and is magnetically biased away from the second condition when the second magnet of the first mount assembly is adjacent to the first magnet of the second mount assembly.

In a second aspect, the first and second magnets can be mounted to an underside side of the first mount.

In another aspect, the first magnet of the second mount assembly may be mounted to an upper side of the second mount facing the underside of the first mount when the rotating mount assembly is arranged in the first condition.

In another aspect, the second mount assembly can further include a second magnet having the first polarity. The panel can be magnetically biased to the first condition when the second magnet of the first mount assembly is adjacent to the second magnet of the second mount assembly. Furthermore, the panel can be magnetically biased away from the second condition when the first magnet of the first mount assembly is adjacent to the second magnet of the second mount assembly.

In another aspect, the first mount assembly can further include a third magnet having the second polarity. The panel can be magnetically biased away from the second condition when the third magnet of the first mount assembly is adjacent to the first magnet of the second mount assembly.

In yet another aspect, the second and third magnets of the first mount assembly can be arranged at opposite angular positions about the pivot axis and relative to the first magnet of the first mount assembly. The second and third magnets of the first mount assembly may be configured to magnetically bias the rotating mount assembly towards the first condition when the rotating mount assembly pivots clockwise or counterclockwise, respectively.

In another aspect, the pivotable connection can include a shaft formed integrally with one of the first and second mounts.

In another aspect, the rotating mount assembly may further include a bearing positioned between the shaft and said one of the first and second mounts.

In another aspect, the first mount can include a first arm and a second arm, the first and second arm defining a slot therebetween for pivotably receiving the second mount.

In yet another aspect, the second mount can include a finger positioned within the slot in the first mount and hinged to the first and second arms.

In another aspect, the pivotable connection may include a shaft extending through the first and second arms and the finger and providing the pivot axis.

In another aspect, the first arm can include the first and second magnets of the first mount assembly.

In another aspect, the second arm can include a first magnet having a first polarity and a second magnet having a second polarity opposite the first polarity. The second mount assembly may include an additional magnet having the second polarity. The panel can be magnetically biased to the first condition when the first magnet of the second arm is adjacent to the additional magnet of the second mount assembly, and can be magnetically biased away from the second condition when the second magnet of the second arm is adjacent to the additional magnet of the second mount assembly.

In yet another aspect, the first arm can further include a third magnet having the second polarity. The panel can be magnetically biased away from the second condition when the third magnet of the first arm is adjacent to the first magnet of the second mount assembly.

In another aspect, the second and third magnets of the first arm can be arranged at opposite angular positions about the pivot axis and relative to the first magnet of the first arm, and can be configured to magnetically bias the rotating mount assembly towards the first condition when the rotating mount assembly pivots clockwise or counterclockwise, respectively.

In another aspect, the second arm can include a third magnet having a second polarity opposite the first polarity. The panel can be magnetically biased away from the second condition when the third magnet of the second arm is adjacent to the additional magnet of the second mount assembly.

In another aspect, the second and third magnets of the second arm can be arranged at opposite angular positions about the pivot axis and relative to the first magnet of the second arm, and can be configured to magnetically bias the rotating mount assembly towards the first condition when the rotating mount assembly pivots clockwise or counterclockwise, respectively.

In yet another aspect, the panel can include at least one of an informational sign, a visual barrier, and a sporting backboard.

Introducing a method of biasing a panel from a deflected condition to an un-deflected condition comprising:

providing a first mount assembly attached to a panel and including a first mount, a first magnet having a first polarity and a second magnet having a second polarity opposite the first polarity; a second mount assembly rotatably attached to the first mount assembly by a shaft and having a second mount and a third magnet having the second polarity;

impacting the panel with an external force to rotate the first mount assembly relative to the second mount assembly bringing the second magnet adjacent the third magnet;

rotating the first mount relative to the second mount back to the un-deflected condition by repelling the second magnet with the third magnet.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a magnetically resettable panel assembly that is magnetically biased to a first condition, and is returnable to the first condition when wind or other interaction forces an attached panel of the resettable panel assembly to a second condition, in order to simply and economically maintain the attached panel in the desired first condition for the benefit of viewers or users.

Figure 1:
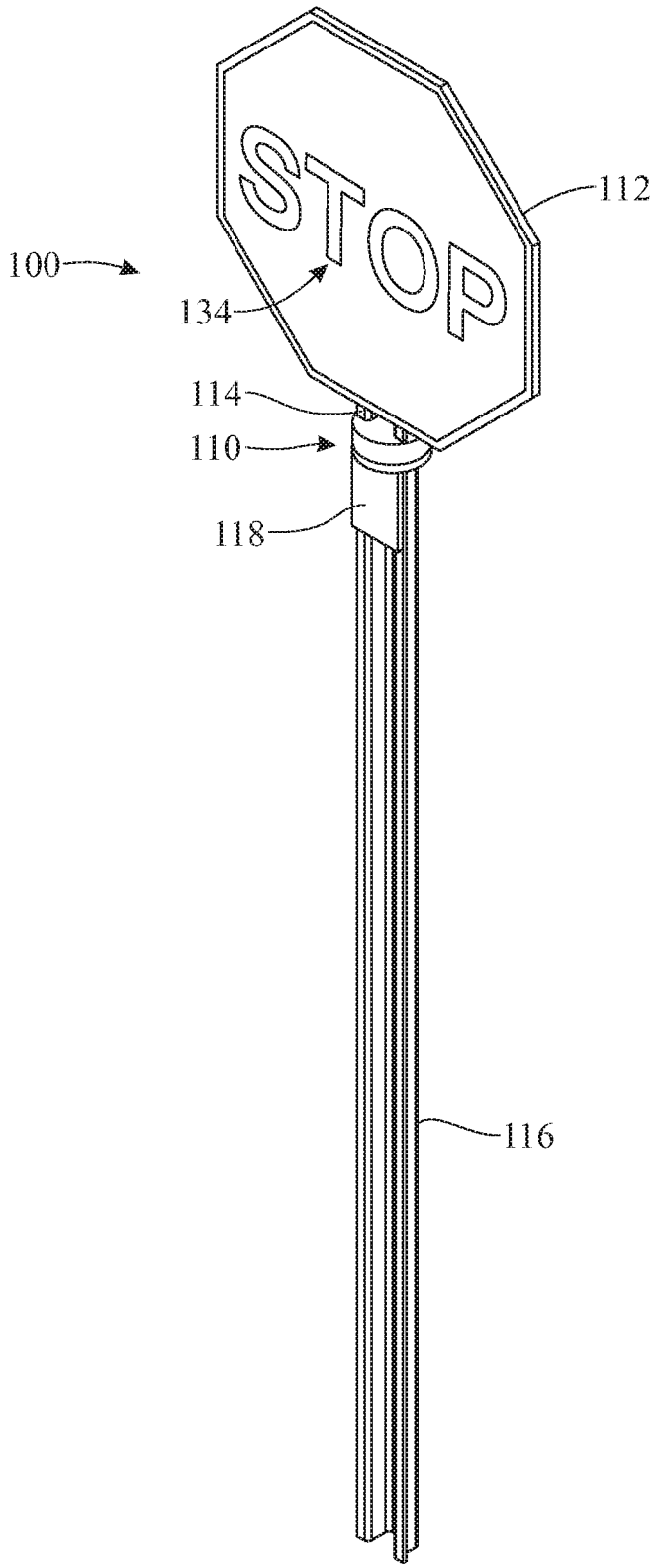
FIG. 1 presents a top front perspective view of a magnetically resettable panel assembly in accordance with a first illustrative embodiment of the present invention, wherein the magnetically resettable panel assembly incorporates a magnetically resettable rotating mount assembly, rotatable about a vertical axis, and an attached panel, both of which are shown in a first or un-deflected condition.
Figure 2:
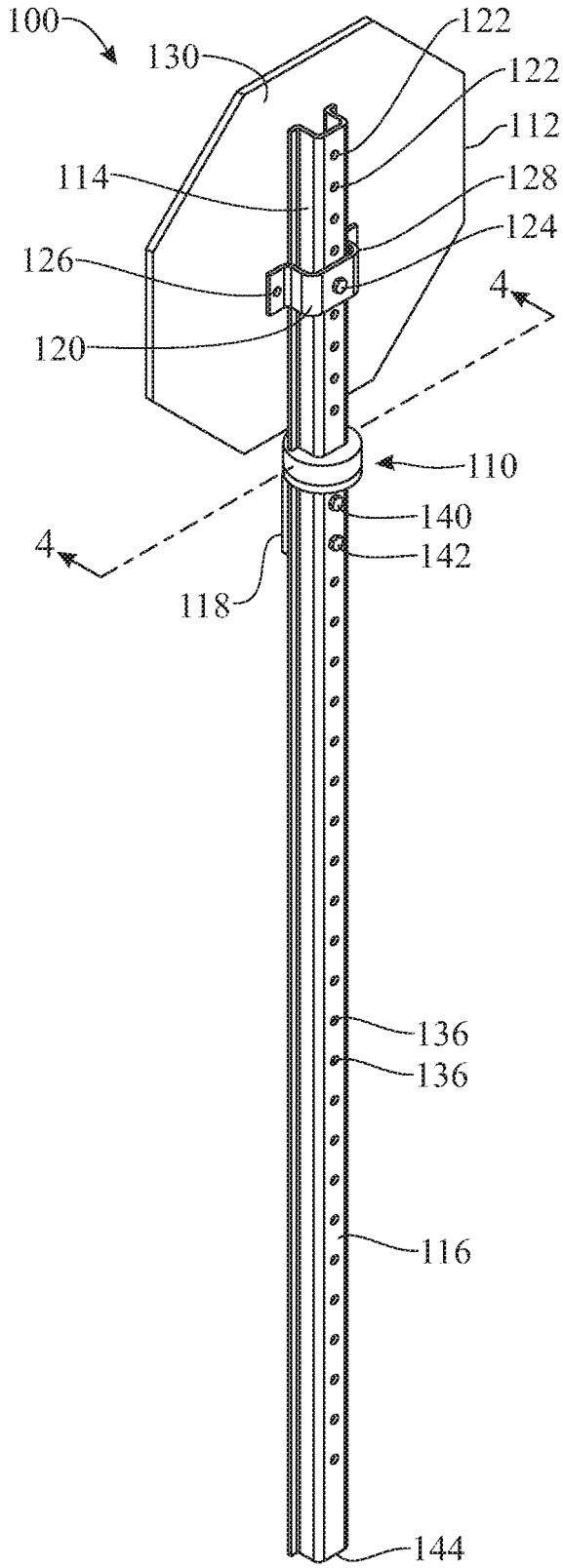
FIG. 2 presents a top rear perspective of the magnetically resettable panel assembly of FIG. 1 with the attached panel in the first un-deflected condition.
Figure 3:
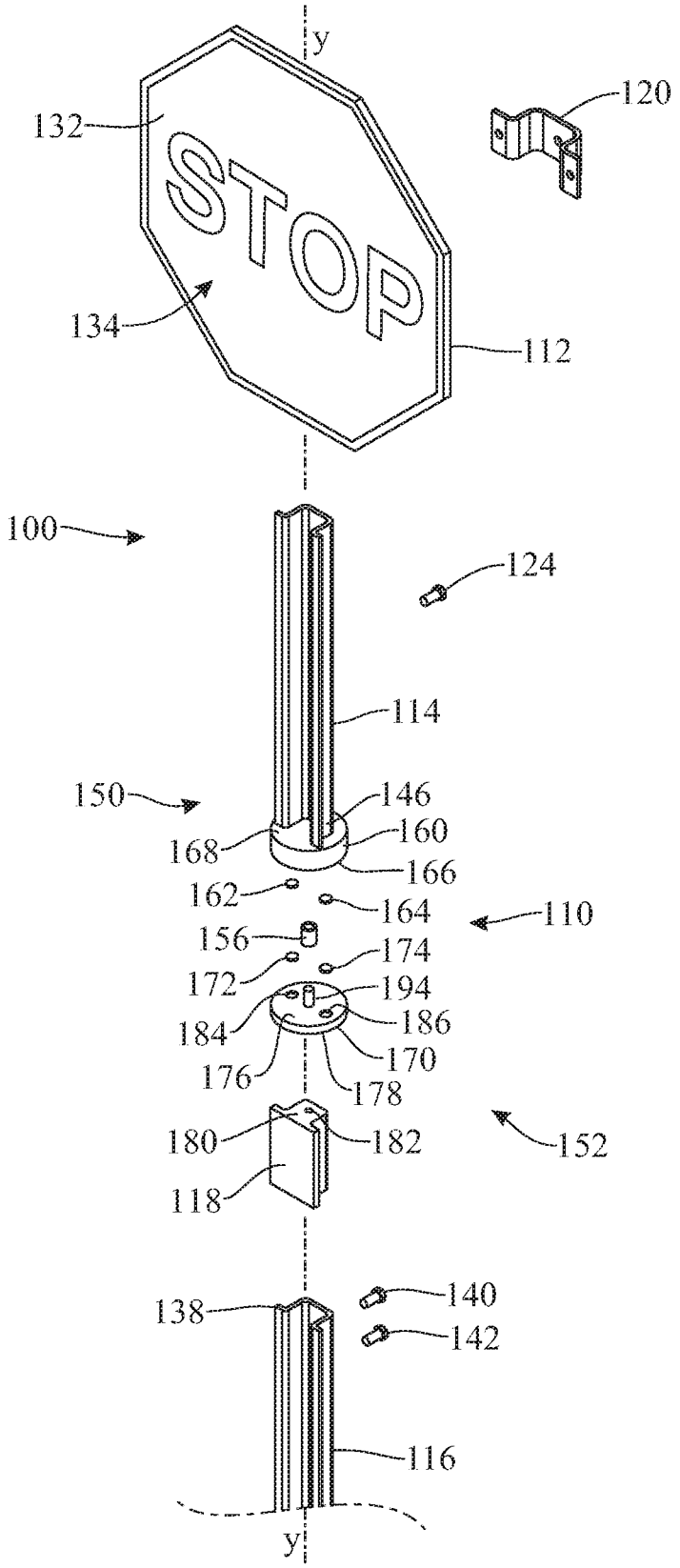
FIG. 3 presents an exploded, top front perspective view, of the magnetically resettable panel assembly of FIG. 1.

Referring to FIGS. 1-3, and initially with regard to FIG. 1, a magnetically resettable panel assembly 100 is illustrated in accordance with an exemplary first embodiment of the present invention, configured as a rotating stop sign. As shown, the magnetically resettable panel assembly 100 generally includes a pivotable or rotating mount assembly 110 supporting an outdoor panel 112. The outdoor panel 112 can be of the type to display information, such as, but not limited to, highway signs, a stop sign (as shown), or other types of outdoor signs that need to maintain a specific orientation such as, but not limited to, basketball back boards, shooting target backings, etc. The rotating mount 110 assembly allows the outdoor panel 112 to be deflected due to external forces from a desired, first or un-deflected condition to a second or deflected condition without damage to the outdoor panel 112. The rotating mount 110 further allows the outdoor panel 112, when deflected, to automatically return to the first or un-deflected condition when the external forces diminish or cease to be present. Theses external forces may include wind or impact from external objects such as, for example, interaction with vehicles, persons, flying debris, etc.

With continued reference to FIG. 1, the outdoor panel 112 is secured to the rotating mount assembly 110 by a top post 114 and the rotating mount assembly 110 is secured to the ground by an attached bottom post 116. A bottom support 118 is provided to removably attach the rotating mount assembly 110 to the bottom post 116 to facilitate removal for replacement and/or repair. While not specifically shown, the bottom post 116 can be secured to the ground in known manner. Alternatively, the magnetically resettable panel assembly 100 can be mounted to other external structures such as buildings, platforms, etc. without departing from the scope of the present disclosure.

Referring now to FIGS. 2 and 3, the outdoor panel 112 is affixed to the top post 114 by a bracket 120. Specifically, the top post 114 of the present embodiment is a U-channel type post having multiple mounting holes 122 to allow vertical adjustment of the position of the outdoor panel 112 relative to the rotating mount assembly 110. The bracket 120 is fitted around the top post 114 and secured to the top post 114 by a bolt 124 anchored within one of the mounting holes 122 and secured therein by a nut (not shown). The bracket 120 is secured to the outdoor panel 112 by a pair of fasteners or screws 126 and 128 (FIG. 2). The bracket 120 and screws 126 and 128 are affixed to a back side 130 of the outdoor panel 112 (FIG. 2) while a front side 132 of the outdoor panel 112 includes indicia 134 for display of information (FIG. 3).

Likewise, as best shown in FIGS. 1-3, the bottom post 116 is also a U-channel type post having multiple mounting holes 136 (FIG. 2). The bottom support 118 is removably and non-rotatably attached to a top end 138 of the bottom post 116 by a pair of fasteners 140 and 142, shown in FIGS. 2 and 3. As noted above, a bottom end 144 of the bottom post 116 (FIG. 2) can be secured to the ground in known manner. As noted above, the bottom support 118 is affixed to the rotatable mounting assembly 110. A bottom end 146 of the top post 114 is also affixed to the rotatable mounting assembly 110.

Referring now specifically to FIG. 3, the rotatable mounting assembly 110 is provided to automatically reorient the outdoor panel 112 from the second or deflected condition back to the first or un-deflected condition after the outdoor panel 112 has been deflected by outside forces and the outside forces have ceased or sufficiently decreased. The rotatable mounting assembly 110 includes an upper mount assembly 150 affixed to the top post 114 and a bottom mount assembly 152 affixed to the bottom support 118. The upper mount assembly 150 is rotatably mounted on, and movable relative to, the bottom mount assembly 152 about a vertical axis y-y such that the outdoor panel 112 can rotate or revolve relative to the bottom post 116 when acted upon by outside forces. The rotatable mounting assembly 110 further includes a center pin or center shaft 154, shown in FIG. 4, positioned between the upper and lower mount assemblies 150 and 152, respectively. The shaft 154 allows the upper mount assembly 150 to rotate relative to the lower mount assembly 152. The shaft 154 is preferably affixed to the lower mount assembly 152. A bearing 156 can be provided about the shaft 154 to facilitate rotation of the upper mount assembly 150 relative to the lower mount assembly 152.

The upper mount assembly 150 generally includes an upper base or mount 160 having a primary or first magnet 162 and a secondary or second magnet 164 mounted within the upper mount 160. Specifically, the first and second magnets 162 and 164, respectively, can be mounted such that they are exposed through an under or bottom side 166 of the upper mount 160 as discussed in more detail hereinbelow. The first magnet 162 has a first polarity while the second magnet 164 has an opposite, second polarity. For example, in some embodiments such as the present embodiment, the first polarity is a positive polarity and the second polarity is a negative polarity. As shown, the bottom end 146 of the top post 114 is secured to an upper or top side 168 of the upper mount 160.

Figure 4:
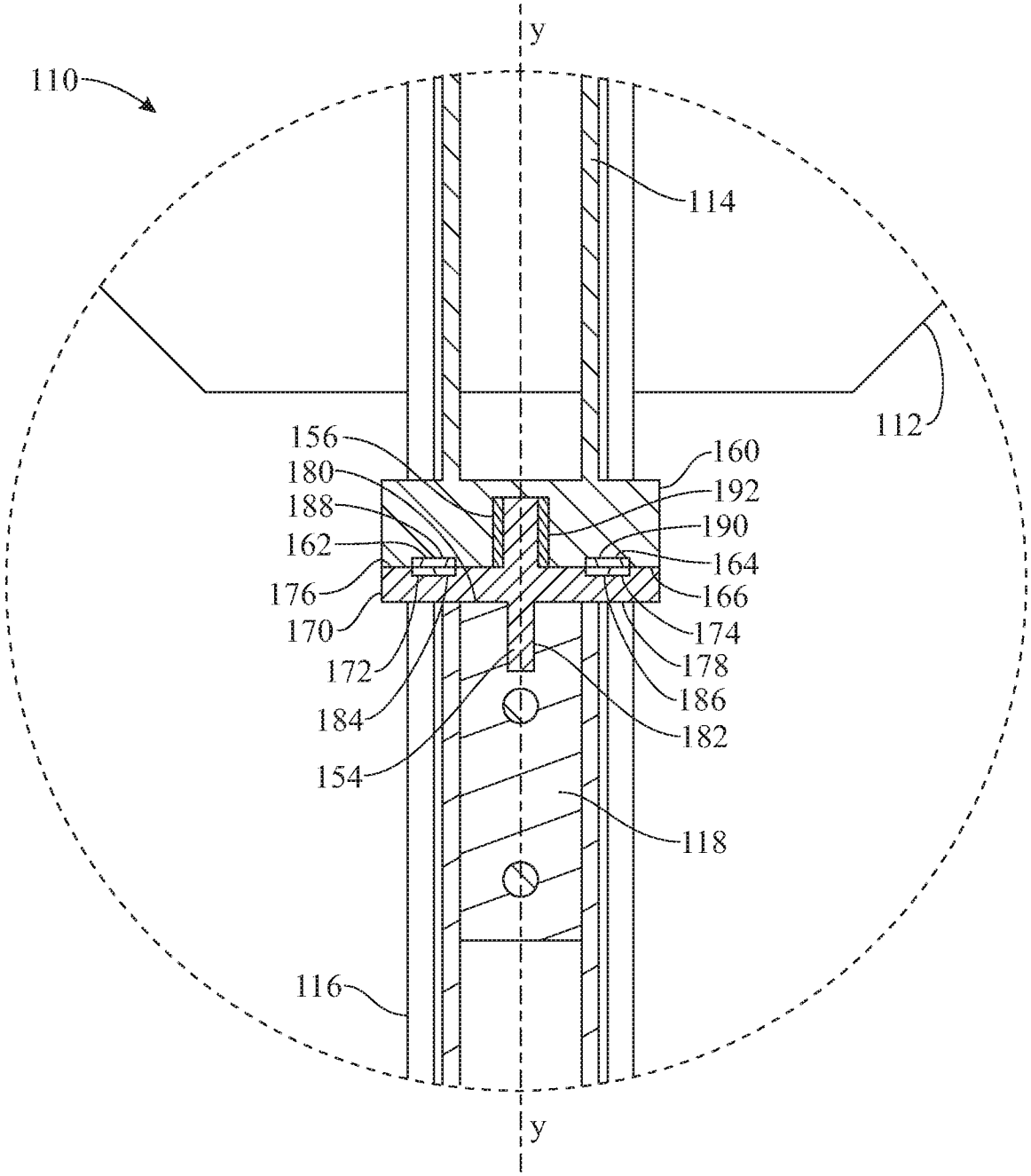
FIG. 4 presents a cross-sectional rear elevation view of the rotating mount assembly taken along section plane 4-4 of FIG. 2.

Referring to FIGS. 3 and 4, the lower mount assembly 152 is complementary to the upper mount assembly 150 and generally includes a lower base or mount 170 having third and fourth magnets 172 and 174, respectively, mounted therein. The third and fourth magnets 172 and 174 can be exposed through an upper or top side 176 of the lower mount 160. Similar to the first and second magnets 162 and 164 described hereinabove, the third and fourth magnets 172 and 174 have differing polarities. In this embodiment, for instance, the third and fourth magnets 172 and 174 have second and first polarities, respectively, which are negative and positive. As shown, a lower or bottom side 178 of the lower mount 170 is affixed to a top side 180 of the bottom support 118. The top side 180 of the bottom mount 118 additionally includes a hole or bore 182 for receipt of the shaft 154. As, also shown, the top side 176 of the lower mount 170 is provided with recesses 184 and 186 for receipt of the third and fourth magnets 172 and 174, respectively.

It is important to the operation of the rotatable mounting assembly 110 that the first and third magnets 162 and 172, respectively, have opposing polarities relative to one another, and that the second and fourth magnets 164 and 174 also to have opposing polarities relative to one another. Thus, if the first and second magnets 162 and 164 have differing polarities, the third and fourth magnets 172 and 174 also have differing polarities. Since opposite polarities attract each other and common polarities repel each other, this arrangement of polarities in the magnets contained in the upper and lower mount assemblies 150 and 152, respectively, ensures the upper and lower mount assemblies 150 and 152 will assume the first or un-deflected condition in the absence of outside forces and be biased away from the second or deflected condition in the presence of outside forces as discussed in more detail hereinbelow.

Referring specifically to FIG. 4, the first and second magnets 162 and 164 are retained within recesses 188 and 190 formed in the bottom side 166 of the upper mount 160. The bearing 156 is retained within a bore 192 formed through the bottom side 166 in the upper mount 160. The shaft 154 is free to rotate within the bearing 156. As shown, the shaft 154 extends through the lower mount 170 and may be formed integrally therewith.

In this illustration, the rotating mount assembly 110 is illustrated in the first or un-deflected condition. The first magnet 162 has a first polarity which is positive and the second magnet 164 has a second polarity which is negative. The third magnet 172 has the second polarity which is negative and the fourth magnet 174 has the first polarity which is positive. The mutual attraction between the first polarity of the first magnet 162 and the second polarity of the third magnet 172 and the mutual attraction of the second polarity of the second magnet 164 and the first polarity of the fourth magnet 174 maintains the magnetically resettable panel assembly 100 in the first or un-deflected condition shown in the figure, until acted upon by outside forces.

Referring now to FIGS. 1-5, the operation of the rotating mount assembly 110 of the magnetically resettable panel assembly 100 to return the panel 112 to a desired first or un-deflected condition after being deflected by outside forces will now be described.

As noted above, in the first or un-deflected condition, the panel 112 faces in a desired direction displaying the indicia 134 in the desired direction and is maintained in the first condition by the opposing magnetic forces in the upper and lower mount assemblies 150 and 152 as shown in FIGS. 1 and 4. In this condition, it can be said that the upper and lower mount assemblies 150 and 152 are magnetically rotated and biased to the static first and un-deflected condition about the y-y axis.

Figure 5:
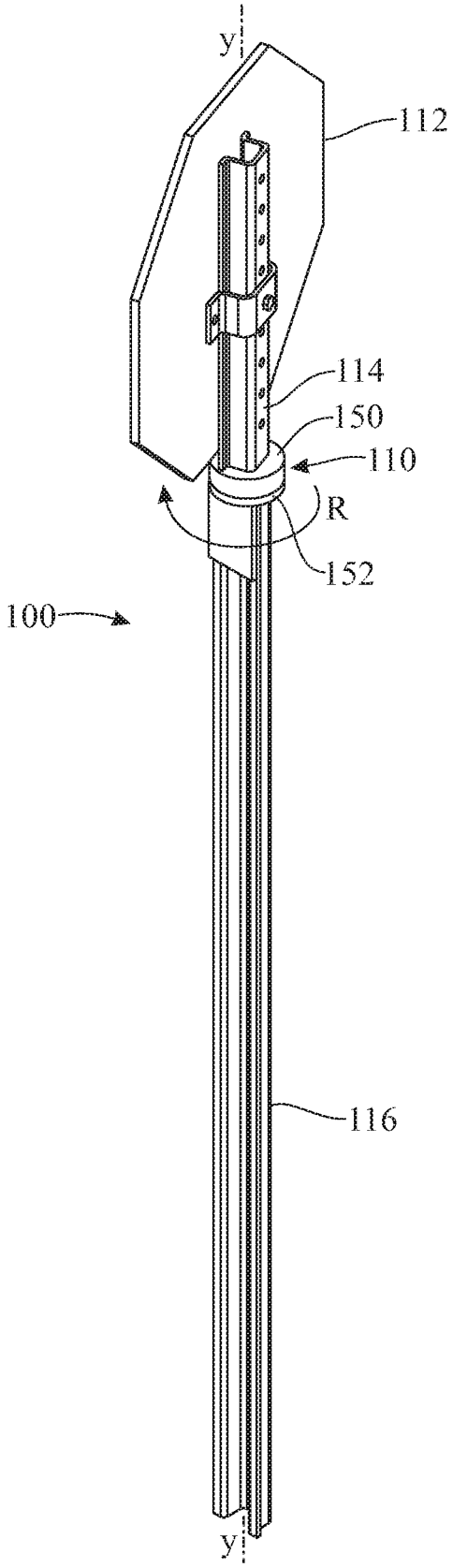
FIG. 5 presents a top front perspective view of the magnetically resettable panel assembly of FIG. 1 with the attached panel in a second or deflected condition.

As shown in FIG. 5, when a sufficiently strong outside force such as wind or an impact impinges upon the panel 112, the panel 112 is forced to be rotated about the shaft 154 in the direction of arrow "R" to the second or deflected condition such that the panel 112 faces an undesired direction and the indicia 134 is no longer visible. In this second condition, the first and second magnets 162 and 164 are rotated away from the third and fourth magnets 172 and 174, respectively. Because opposite polarities attract, the first magnet 162 is magnetically biased toward and wants to return to its opposed position relative to the third magnet 172 and the second magnet 164 is magnetically biased toward and wants to return to its opposed position relative to the fourth magnet 174. Additionally, should the panel 112 be rotated far enough, the first magnet 162 approaches the fourth magnet 174 and the second magnet 164 approaches the third magnet 172. Because like polarities repel each other, the first magnet 162 is magnetically repelled or biased away from the fourth magnet 174 and the second magnet 164 is magnetically repelled or biased away from the third magnet 172. In this second condition, it can be said that the upper and lower mount assemblies 150 and 152 are magnetically rotatably biased or repelled away from each other about the y-y axis.

When the outside forces are removed, such as when the wind dies down or diminishes below the level of the magnetic forces, the mutual opposition magnetic forces of the identical polarity first magnet 162 and fourth magnet 174 and the identical polarity of the second magnet 164 and the third magnet 172 forces the upper mount assembly 150 to rotate back about the y-y axis toward the first un-deflected condition. The mutual attraction between the first magnet 162 and the third magnet 172 and the mutual attraction between the second magnet 164 and the fourth magnet 174 further draw the upper and lower mount assemblies 150 and 150 back to the first or un-deflected condition, securing the upper and lower mount assemblies 150 and 150 in the first or un-deflected condition until again acted upon by outside forces.

In this manner, the magnetically resettable panel assembly 100 easily allows the panel 112 to be deflected by outside forces without damage to the panel 112 and return to the original un-deflected condition when the outside forces cease. Because the biasing forces of the magnetically resettable panel assembly 100 are magnetic rather than mechanical, the magnetically resettable panel assembly can undergo an almost unlimited amount of deflection and return cycles without any danger of metal fatigue to its components.

Figure 6:
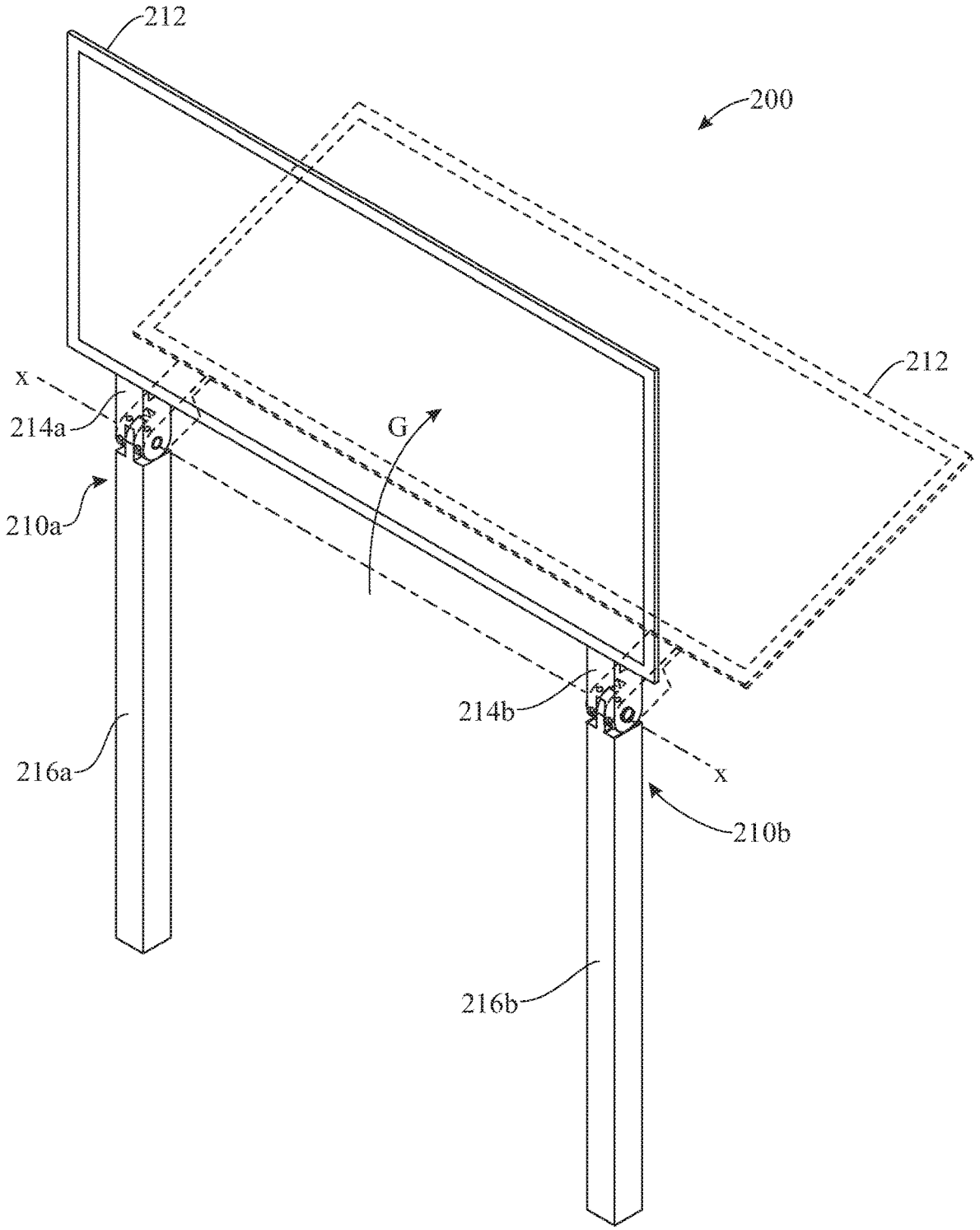
FIG. 6 presents top front perspective view of a magnetically resettable panel assembly in accordance with a second illustrative embodiment of the present invention, wherein the magnetically resettable panel assembly incorporates two magnetically resettable rotating mount assemblies, rotatable about a horizontal axis, and an attached panel, all of which are shown in a first or un-deflected condition shown in solid lines and in a second or deflected condition shown in phantom.

Referring now to FIGS. 6-10, a second or alternative embodiment of a magnetically resettable panel assembly 200 is disclosed. Referring initially to FIG. 6, the magnetically resettable panel assembly 200 generally includes a pair of rotating mount assemblies 210*a* and 210*b* supporting an outdoor panel 212. The rotating mount assemblies 210*a* and 210*b* are connected to the outdoor panel 212 by a pair of top posts 214*a* and 214*b* extending from the rotating mount assemblies 210*a* and 210*b*, respectively. The rotating mount assemblies 210*a* and 210*b* are connected to the ground by a pair of bottom posts 216*a* and 216*b*. The rotating mount assemblies 210*a* and 210*b* of the present embodiment allow the panel 212 to pivot about a horizontal axis x-x to prevent damage to the panel 212 due to the forces of wind or impact. In this embodiment, the rotating mount assemblies 210*a* and 210*b* are identical to one another and will be discussed simply as rotating mount assembly 210. Likewise, the top posts 214*a* and 214*b* are identical to one another and the bottom posts 216*a* and 216*b* are identical to one another and will simply be discussed as top post 214 and bottom post 216.

Figure 7:
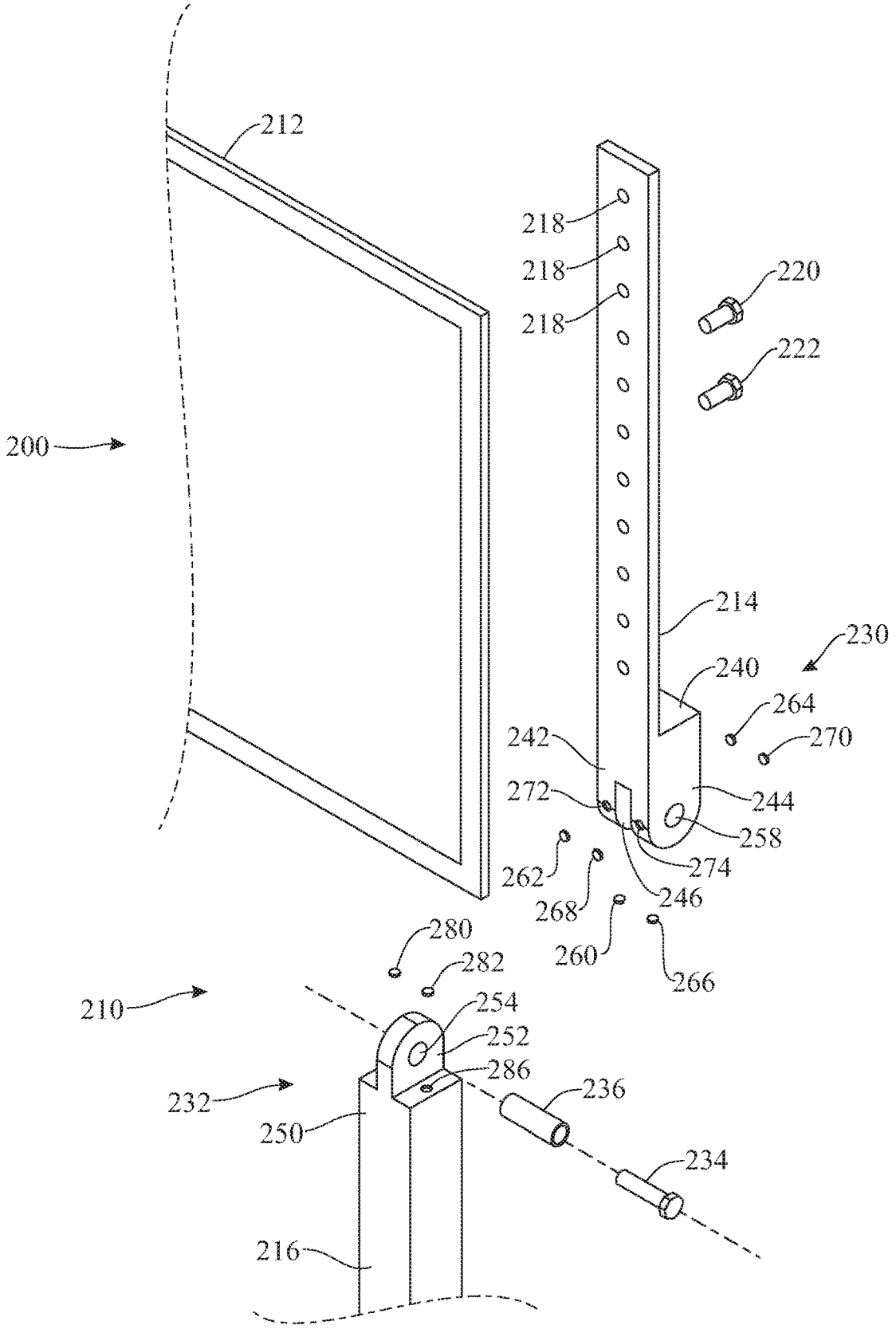
FIG. 7 presents an exploded, partial top front perspective view of the magnetically resettable panel assembly of FIG. 6.
Figure 8:
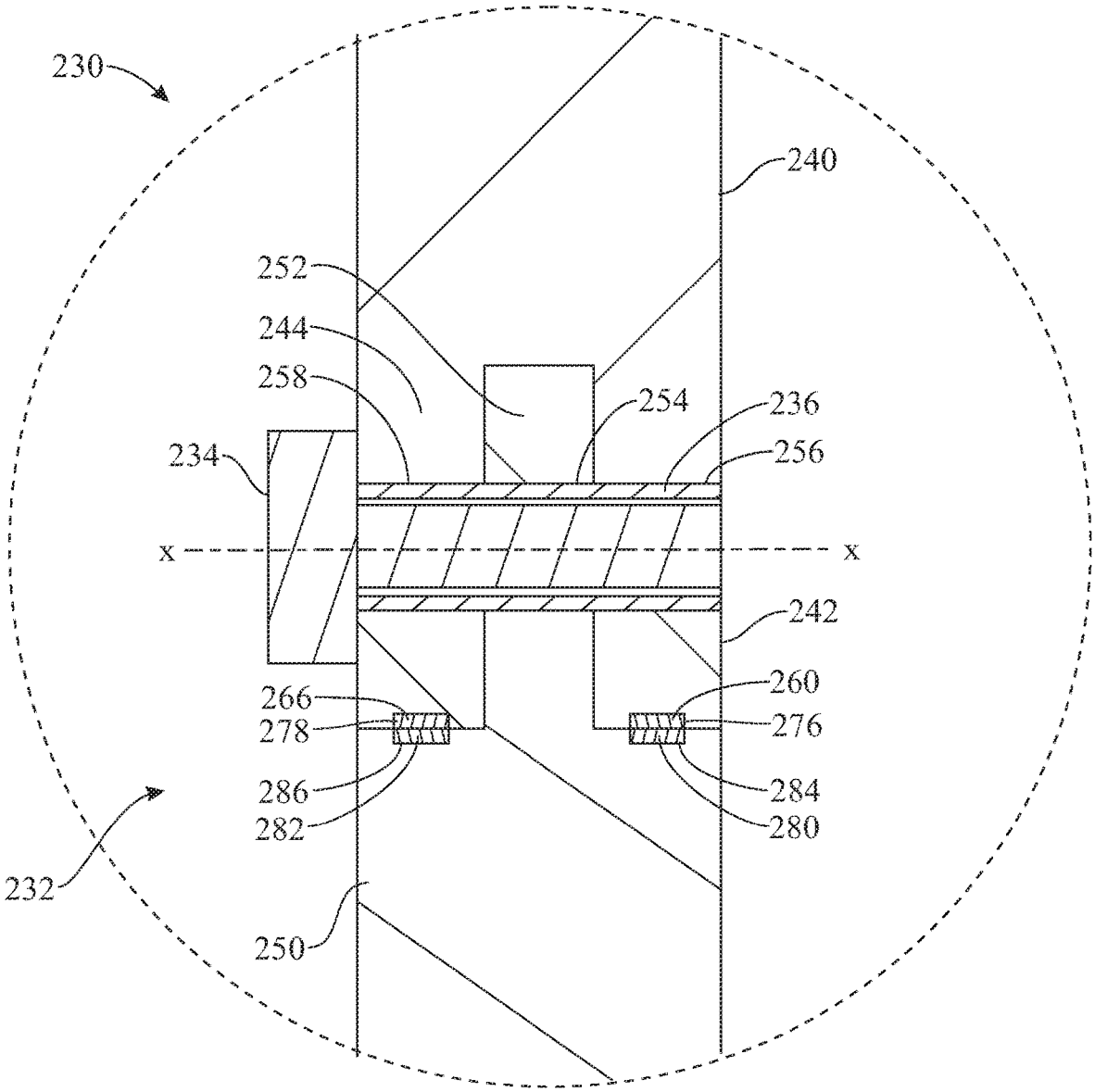
FIG. 8 presents an enlarged cross-sectional rear elevation view of one of the rotating mount assemblies of the magnetically resettable panel assembly of FIG. 6.
Figure 9:
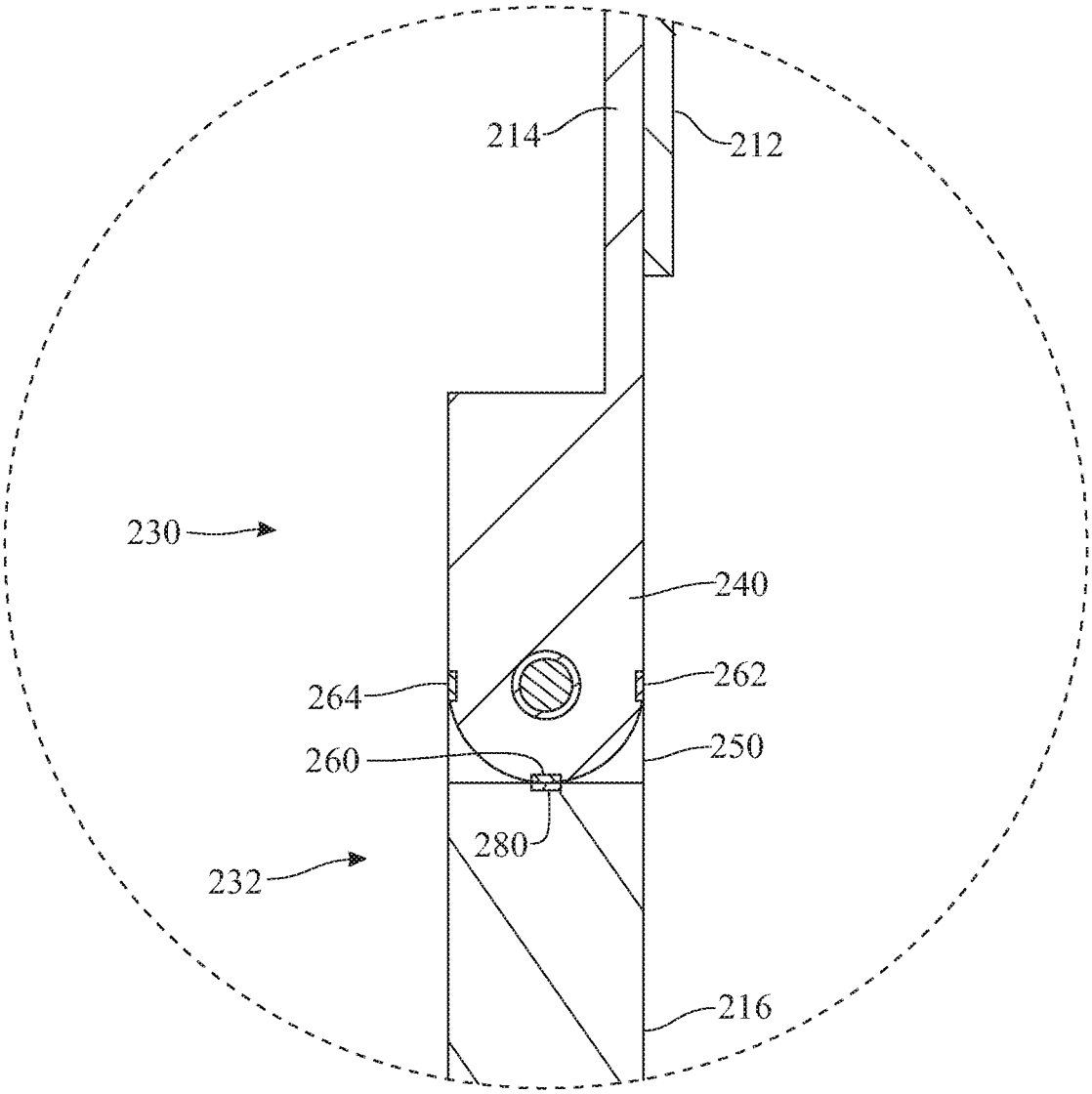
FIG. 9 presents an enlarged cross-sectional side elevation view of one of the rotating mount assemblies of the magnetically resettable panel assembly FIG. 6 in the first or un-deflected condition.

Referring to FIGS. 7-9, and initially with regard to FIG. 7, the panel 212 is of the type that is subject to damaging winds and debris; for example, the panel 212 can be of the type for displaying information, to act as a visual barrier, as a sporting backboard, etc. The panel 212 is affixed to the top post 214. Specifically, the top post 214 includes a plurality of mounting holes 218 and is attached to the panel 212 by a pair of bolts 220 and 222 extending through the mounting holes 218 and into the panel 212.

The rotating mount assembly 210 generally includes a top or upper mount assembly 230 and a bottom or lower mount assembly 232 which is pivotally connected to the upper mount assembly 230. The upper and lower mount assemblies 230 and 232 are pivotally connected by a shaft or pivot pin 234 such that the upper mount assembly 230 can rotate or pivot relative to the lower mount assembly 232. A bearing 236 is provided about the pivot pin 234 to facilitate rotation of the upper mount assembly 230 relative to the lower mount assembly 232. The upper mount assembly 230 includes an upper mount 240 having a downwardly-projecting first arm 242 and a downwardly-projecting second arm 244 which define a slot 246 therebetween. The lower mount assembly 232 includes a lower mount 250 having an upwardly-projecting finger 252 which extends into the slot 246 in the upper mount 240. The projecting finger 252 of the lower mount 250 defines a horizontal bore 254 and the first and second arms 242 and 244 of the upper mount 240 define respective horizontal bores 256 and 258. The pivot pin 234 and the bearing 236 extend through the bores 254, 256 and 258 to pivotally connect the upper mount assembly 230 to the lower mount assembly 232.

The upper and lower mount assemblies 230 and 232 are similar to the upper and lower mount assemblies 150 and 152 of the magnetically resettable panel assembly 100 described hereinabove in that they include magnets which maintain the panel 212 in an upright or un-deflected condition in the absence of wind or impact and magnetically bias the panel 212 from a second deflected condition back to the first un-deflected condition. Specifically, with regard to the upper mount assembly 150, the first arm 242 of the upper mount 240 includes a primary or first magnet 260 having a first polarity and oriented such that the panel 212 is maintained in the upright first or un-deflected condition and a secondary or second magnet 262 having a second polarity opposite the first polarity. The first arm 242 additionally includes an additional secondary magnet, or third magnet 264, having the second polarity opposite the first polarity. The second and third magnets 262 and 264 are spaced on either side of the first magnet 260 and operate to bias the panel 212 from the deflected to the un-deflected condition. Likewise, the second arm 244 includes a fourth magnet 266 oriented to maintain the panel 212 in the un-deflected condition and secondary, fifth and sixth magnets 268 and 270, spaced on either side of the fourth magnet 266, to bias the panel 212 from the deflected condition back to the un-deflected condition in a manner described in more detail hereinbelow. The fourth magnet 266 has an opposite polarity from the fifth and sixth magnets 268 and 270.

The second magnet 262 and the fifth magnet 268 are secured within recesses 272 and 274 on a first or front side of the first and second arms 242 and 244, respectively (FIG. 7). The first magnet 260 and the fourth magnet 266 are retained in recesses 276 and 278 formed at the bottom of the first and second arms 242 and 244, respectively (FIG. 8). While not specifically shown, the third and sixth magnets 264 and 270 are also retained in recesses formed on a second or rear side of the first and second arms 242 and 244, respectively.

Turning now to the lower mount assembly 232, the lower mount 250 includes a pair of tertiary magnets including a seventh magnet 280 positioned on one side of the finger 252 and an eighth magnet 282 positioned on an opposite side of the finger 252. The seventh magnet 280 is positioned in a recess 284 on one side of the finger 252 in the lower mount 150 and the eighth magnet 282 is positioned in a recess 286 in the lower mount 150 and on an opposite side of the finger 252.

The seventh and eighth magnets 280 and 282 of the lower mount assembly 232 have the opposite polarity from the first and fourth magnets 260 and 266 of the upper mount assembly 230 such that the first and fourth magnets 260 and 266 are attracted to the seventh and eighth magnets 280 and 282 of the lower mount assembly 232, respectively, to maintain the panel 212 in an upright position or un-deflected condition (FIGS. 8 and 9).

Figure 10:
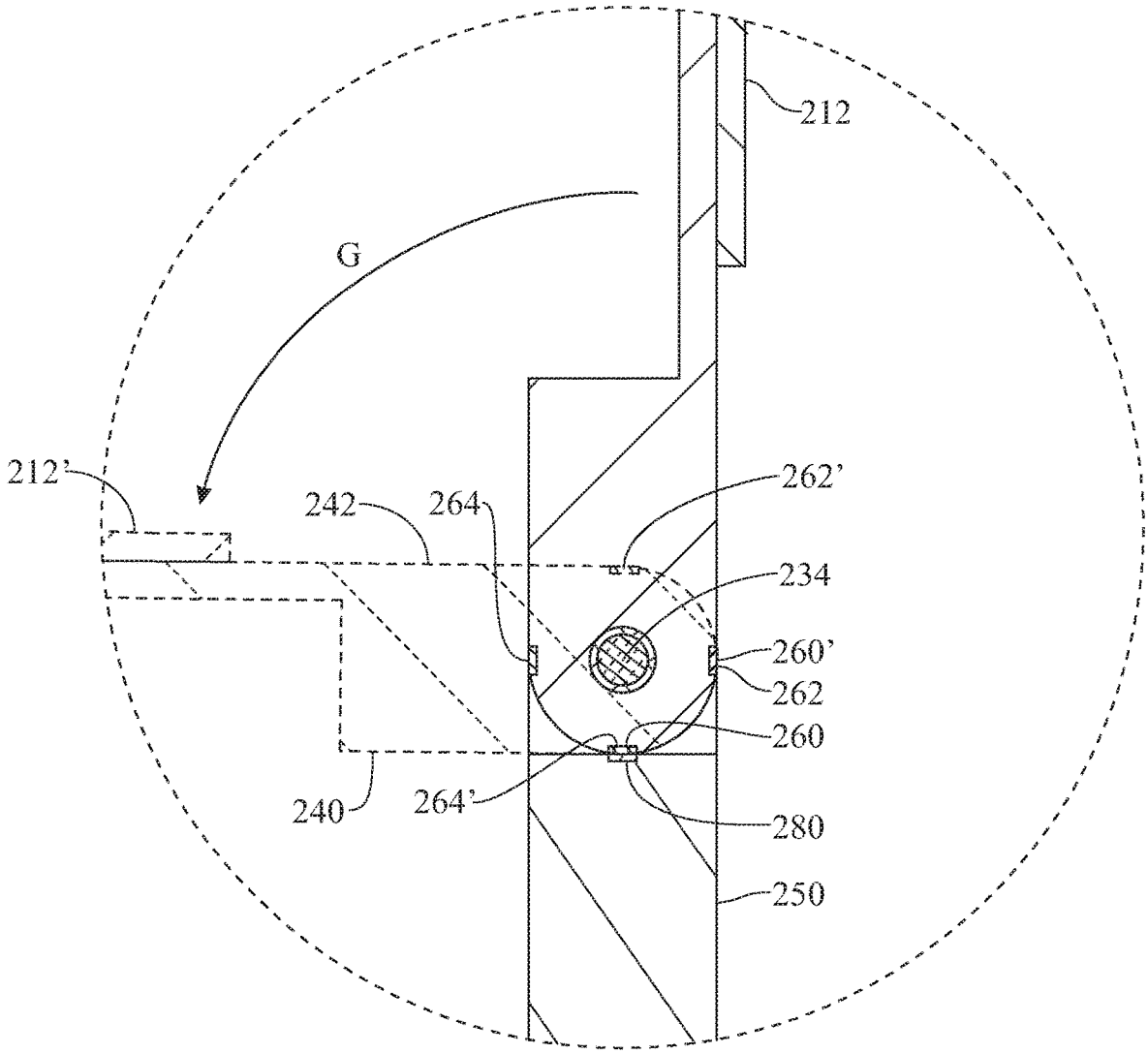
FIG. 10 presents a view similar to FIG. 9, illustrating the attached panel shown in solid lines in the first or un-deflected condition and in the second or deflected condition as shown in phantom.

Turning now to FIG. 10, in use, the panel 212 is initially in an upright or un-deflected condition as shown in solid lines. In the event of excessive wind or impact from an external object, the panel 212 is moved or pivoted about the horizontal x-x axis (FIGS. 6 and 8) from the un-deflected condition in the direction of arrow "G" to a deflected condition shown in phantom and with the panel indicated with reference numeral 212' (throughout the following description, apostrophes will be used to indicate the deflected condition).

As shown in phantom in FIG. 10, in the deflected condition, the first magnet 260' in first arm 242 of the upper mount 240 is offset from the opposing polarity seventh magnet 280 in the lower mount 250. The upper mount 240 is in a position placing the third magnet 264' in the upper mount 240 against or near the common polarity seventh magnet 280 in the lower mount 240. When the deflecting event (e.g., strong wind) passes, the common polarity third and seventh magnets 264' and 280 repel each other to drive the panel back to its upright or un-deflected condition indicated by reference numeral 212. Should the panel 212 be deflected in a direction opposite arrow "G", the second magnet 262 will line up with or be close to the common polarity seventh magnet 280 and again will be biased back to the un-deflected condition when the deflecting event passes.

While not specifically shown, the magnets on the second arm 244 are also maintaining the panel 212 in the upright un-deflected condition when the fourth magnet 266 is adjacent the opposite polarity eighth magnet 282 and biasing the panel away from the deflected condition when the fifth and sixth magnets 268 and 270 are in line with or near the common polarity eighth magnet 282 (see also FIG. 7).

Thus, the magnetically resettable panel assembly 200 also provides a non-mechanical method of maintaining the panel 212 in an upright or un-deflected condition and provides a non-mechanical returning force to return the panel 212 to the un-deflected condition after a deflecting event has passed or diminished.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A resettable panel assembly, comprising:

a panel;

a rotating mount assembly attached to the panel, the rotating mount assembly rotatable between a first condition where the panel is free from external forces and a second condition wherein the panel is deflected by external forces, the rotating mount assembly comprising:

a first mount assembly comprising a first mount, a first magnet having a first polarity and a second magnet having a second polarity opposite the first polarity, a second mount assembly comprising a second mount and a first magnet having the second polarity, and a pivotable connection rotatably connecting the first mount to the second mount about a pivot axis, wherein one of the first and second mounts carries the panel; wherein the panel is magnetically biased to the first condition when the first magnet of the first mount assembly is adjacent to the first magnet of the second mount assembly, and is magnetically biased away from the second condition when the second magnet of the first mount assembly is adjacent to the first magnet of the second mount assembly.

2. The resettable panel assembly of claim 1, wherein the first and second magnets are mounted to an underside of the first mount.

3. The resettable panel assembly of claim 2, wherein the first magnet of the second mount assembly is mounted to an upper side of the second mount facing the underside of the first mount when the rotating mount assembly is arranged in the first condition.

4. The resettable panel assembly of claim 1, wherein the second mount assembly further comprises a second magnet having the first polarity, and further wherein the panel is magnetically biased to the first condition when the second magnet of the first mount assembly is adjacent to the second magnet of the second mount assembly and is magnetically biased away from the second condition when the first magnet of the first mount assembly is adjacent to the second magnet of the second mount assembly.

5. The resettable panel assembly of claim 1, wherein the first mount assembly further comprises a third magnet having the second polarity, wherein the panel is magnetically biased away from the second condition when the third magnet of the first mount assembly is adjacent to the first magnet of the second mount assembly.

6. The resettable panel assembly of claim 5, wherein the second and third magnets of the first mount assembly are arranged at opposite angular positions about the pivot axis and relative to the first magnet of the first mount assembly, and are configured to magnetically bias the rotating mount assembly towards the first condition when the rotating mount assembly pivots clockwise or counterclockwise, respectively.

7. The resettable panel assembly of claim 1, wherein the pivotable connection comprises a shaft formed integrally with one of the first and second mounts.

8. The resettable panel assembly of claim 7, wherein the rotating mount assembly further comprises a bearing positioned between the shaft and said one of the first and second mounts.

9. The resettable panel assembly of claim 1, wherein the first mount comprises a first arm and a second arm, the first and second arm defining a slot therebetween for pivotably receiving the second mount.

10. The resettable panel assembly of claim 9, wherein the second mount comprises a finger positioned within the slot in the first mount and hinged to the first and second arms.

11. The resettable panel assembly of claim 10, wherein the pivotable connection comprises a shaft extending through the first and second arms and the finger and providing the pivot axis.

12. The resettable panel assembly of claim 9, wherein the first arm comprises the first and second magnets of the first mount assembly.

13. The resettable panel assembly of claim 12, wherein the second arm comprises a first magnet having a first polarity and a second magnet having a second polarity opposite the first polarity, and the second mount assembly comprises an additional magnet having the second polarity, and further wherein the panel is magnetically biased to the first condition when the first magnet of the second arm is adjacent to the additional magnet of the second mount assembly, and is magnetically biased away from the second condition when the second magnet of the second arm is adjacent to the additional magnet of the second mount assembly.

14. The resettable panel assembly of claim 12, wherein the first arm further comprises a third magnet having the second polarity, wherein the panel is magnetically biased away from the second condition when the third magnet of the first arm is adjacent to the first magnet of the second mount assembly.

15. The resettable panel assembly of claim 14, wherein the second and third magnets of the first arm are arranged at opposite angular positions about the pivot axis and relative to the first magnet of the first arm, and are configured to magnetically bias the rotating mount assembly towards the first condition when the rotating mount assembly pivots clockwise or counterclockwise, respectively.

16. The resettable panel assembly of claim 14, wherein the second arm comprises a first magnet having a first polarity and second and third magnets having a second polarity opposite the first polarity, and the second mount assembly comprises an additional magnet having the second polarity, and further wherein the panel is magnetically biased to the first condition when the first magnet of the second arm is adjacent to the additional magnet of the second mount assembly, and is magnetically biased away from the second condition when the second or third magnet of the second arm is adjacent to the additional magnet of the second mount assembly.

17. The resettable panel assembly of claim 16, wherein the second and third magnets of the second arm are arranged at opposite angular positions about the pivot axis and relative to the first magnet of the second arm, and are configured to magnetically bias the rotating mount assembly towards the first condition when the rotating mount assembly pivots clockwise or counterclockwise, respectively.

18. The resettable panel assembly of claim 1, wherein the panel comprises at least one of an informational sign, a visual barrier, and a sporting backboard.

19. A resettable panel assembly, comprising:

a panel;

a rotating mount assembly attached to the panel, the rotating mount assembly rotatable between a first condition where the panel is free from external forces and a second condition wherein the panel is deflected by external forces, the rotating mount assembly comprising:

a first mount assembly comprising a first mount, a first magnet having a first polarity and a second magnet having a second polarity opposite the first polarity, a second mount assembly comprising a second mount and a first magnet having the second polarity, and a pivotable connection rotatably connecting the first mount to the second mount about a pivot axis, the pivotable connection comprising a shaft hinging the first mount to the second mount, wherein one of the first and second mounts carries the panel; wherein the panel is magnetically biased to the first condition when the first magnet of the first mount assembly is adjacent to the first magnet of the second mount assembly, and is magnetically biased away from the second condition when the second magnet of the first mount assembly is adjacent to the first magnet of the second mount assembly.

20. A resettable panel assembly, comprising:

a panel;

a rotating mount assembly attached to the panel, the rotating mount assembly rotatable between a first condition where the panel is free from external forces and a second condition wherein the panel is deflected by external forces, the rotating mount assembly comprising:

a first mount assembly comprising a first mount, a first magnet having a first polarity and a second magnet having a second polarity opposite the first polarity, a second mount assembly comprising a second mount and a first magnet having the second polarity, and a pivotable connection rotatably connecting the first mount to the second mount about a pivot axis, the pivotable connection comprising a shaft and a bearing hinging the first mount to the second mount, wherein one of the first and second mounts carries the panel; wherein the panel is magnetically biased to the first condition when the first magnet of the first mount assembly is adjacent to the first magnet of the second mount assembly, and is magnetically biased away from the second condition when the second magnet of the first mount assembly is adjacent to the first magnet of the second mount assembly.

* * * * *